US010535939B1

(12) United States Patent
Qiao et al.

(10) Patent No.: US 10,535,939 B1
(45) Date of Patent: Jan. 14, 2020

(54) CONNECTOR ASSEMBLY

(71) Applicant: 3M INNOVATIVE PROPERTIES COMPANY, St. Paul, MN (US)

(72) Inventors: YunLong Qiao, Singapore (SG); Saujit Bandhu, Singapore (SG); Vincent Tan, Singapore (SG); Kok Hoe Lee, Singapore (SG)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 15/998,476

(22) Filed: Aug. 15, 2018

(51) Int. Cl.

| | |
|---|---|
| ***H01R 12/00*** | (2006.01) |
| ***H01R 12/79*** | (2011.01) |
| ***H01R 12/53*** | (2011.01) |
| ***H01R 12/70*** | (2011.01) |

(52) U.S. Cl.
CPC ..... *H01R 12/79* (2013.01); *H01R 12/53* (2013.01); *H01R 12/7023* (2013.01)

(58) Field of Classification Search
CPC ..... H01R 12/79; H01R 12/53; H01R 12/7023
USPC ..... 439/65, 67, 660
See application file for complete search history.

(56) References Cited

U.S. PATENT DOCUMENTS

| | | | | |
|---|---|---|---|---|
| 5,480,327 | A | 1/1996 | Zola | |
| 6,814,588 | B1 | 11/2004 | Dunlavy | |
| 9,553,394 | B2 * | 1/2017 | Lee | H01R 13/506 |
| 2017/0310029 | A1 | 10/2017 | Lee et al. | |

* cited by examiner

*Primary Examiner* — Khiem M Nguyen
(74) *Attorney, Agent, or Firm* — Clifton F. Richardson

(57) ABSTRACT

A connector assembly including a connector and first and second cables is described. The connector includes an insulative housing and a circuit board partially disposed in the housing. The circuit board includes a mating section and a termination section. The mating section includes a plurality of first contact pads and the termination section includes a plurality of second contact pads electrically connected to the first contact pads. The first and second cables include conductors having front ends terminated at the second contact pads. The housing is overmolded onto and encapsulates at least the front ends of the conductors and the termination section of the circuit board. The circuit board includes a back surface at a rear end of the circuit board and the housing includes a back surface at a cable end of the housing which may be substantially coplanar with the back surface of the circuit board.

18 Claims, 12 Drawing Sheets

CONNECTOR ASSEMBLY

BACKGROUND

Connectors for electrical cables are known. A connector can include an insulative material overmolded onto an end portion of the cable.

SUMMARY

In some aspects of the present description, a connector assembly including a connector and substantially flat first and second cables is provided. The connector includes an insulative housing including a mating end and an opposing cable end, and a circuit board partially disposed in the insulative housing. The circuit board includes a mating section at a front end of the circuit board extending forwardly from the mating end of the insulative housing, and a termination section at a rear end of the circuit board and disposed at the cable end of the insulative housing. The mating section includes a plurality of first contact pads disposed on upper and lower sides of the circuit board for making contact with corresponding contacts of a mating connector. The termination section includes a plurality of second contact pads disposed on the upper and lower sides of the circuit board and electrically connected to the first contact pads. The first and second cables include a plurality of substantially parallel electrical conductors, where front ends of the conductors are terminated at the corresponding second contact pads. The insulative housing is overmolded onto and encapsulates at least the front ends of the conductors and the termination section of the circuit board. The circuit board includes a back surface at the rear end of the circuit board connecting the upper and lower sides of the circuit board. The insulative housing includes a back surface at the cable end of the insulative housing substantially coplanar with the back surface of the circuit board. The first and second cables are spaced apart from each other at the back surface of the insulative housing by at least a thickness of the circuit board.

In some aspects of the present description, a connector assembly including a connector and first and second cables is provided. The connector includes an insulative housing and a circuit board partially disposed in the housing. The first and second cables are terminated at a termination section of the circuit board. The housing is overmolded onto and encapsulates at least the termination section of the circuit board. In some embodiments, the circuit board includes a back surface at a rear end of the circuit board and the housing includes a back surface at a cable end of the housing substantially coplanar with the back surface of the circuit board. In some embodiments, the first and second cables are spaced apart from each other at the back surface of the insulative housing by at least a thickness of the circuit board.

In some aspects of the present description, a method of making a connector assembly is provided. The method includes providing a mold comprising an open port; providing a cable assembly including a circuit board having upper and lower sides and an edge surface connecting the upper and lower sides; and placing the cable assembly at least partially within the mold so that the edge surface of the circuit board is placed substantially at the open port of the mold. The cable assembly further includes a plurality of contact pads disposed on the upper and lower sides of the circuit board proximate the edge surface, and substantially flat first and second cables terminated at the contact pads.

The method further includes disposing a spacer fixture between the first and second cables so that an edge surface of the spacer fixture is substantially aligned, and makes contact or near contact, with the edge surface of the circuit board so that the spacer fixture substantially seals the open port of the mold and maintains a spacing between the first and second cables at the edge surface of the circuit board; molding an insulative housing within the mold over at least the plurality of contact pads; and removing the spacer fixture to provide the connector assembly.

DETAILED DESCRIPTION

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

Connectors for ribbon cables can include a portion overmolded onto a section of a circuit board connected to the cable. Such overmolded portions are described in U.S. Pat. No. 5,480,327 (Zola) and U.S. Pat. No. 6,814,588 (Dunlavy), for example. The overmolded portion in conventional cables extends beyond an end of the circuit board giving additional height to the connector when it is mated with a mating connector mounted on another circuit board, for example. This extended portion of the overmold can result from providing a space beyond the end of the circuit board for upper and lower portions of the mold to press together to seal an open port of the mold. Pressing the upper and lower portions of the mold together pushes the cables together at a back surface of the overmold. In some embodiments of the present description, an insulative housing is overmolded onto and encapsulates at least a termination section of the circuit board, where the insulative housing has a back surface at a cable end of the insulative housing that is substantially coplanar with the back surface of the circuit board at the rear end of the termination section circuit board. Such an overmolded insulative housing can be provided using an injection molding process, for example, where a spacer fixture is used to support upper and lower cables attached to the circuit board near the back surface of the circuit board when the insulative housing is overmolded onto the termination second of the circuit board. In some embodiments, the upper and lower cables are spaced apart from each other at the back surface of the insulative housing by at least a thickness of the circuit board.

Figure 1A:
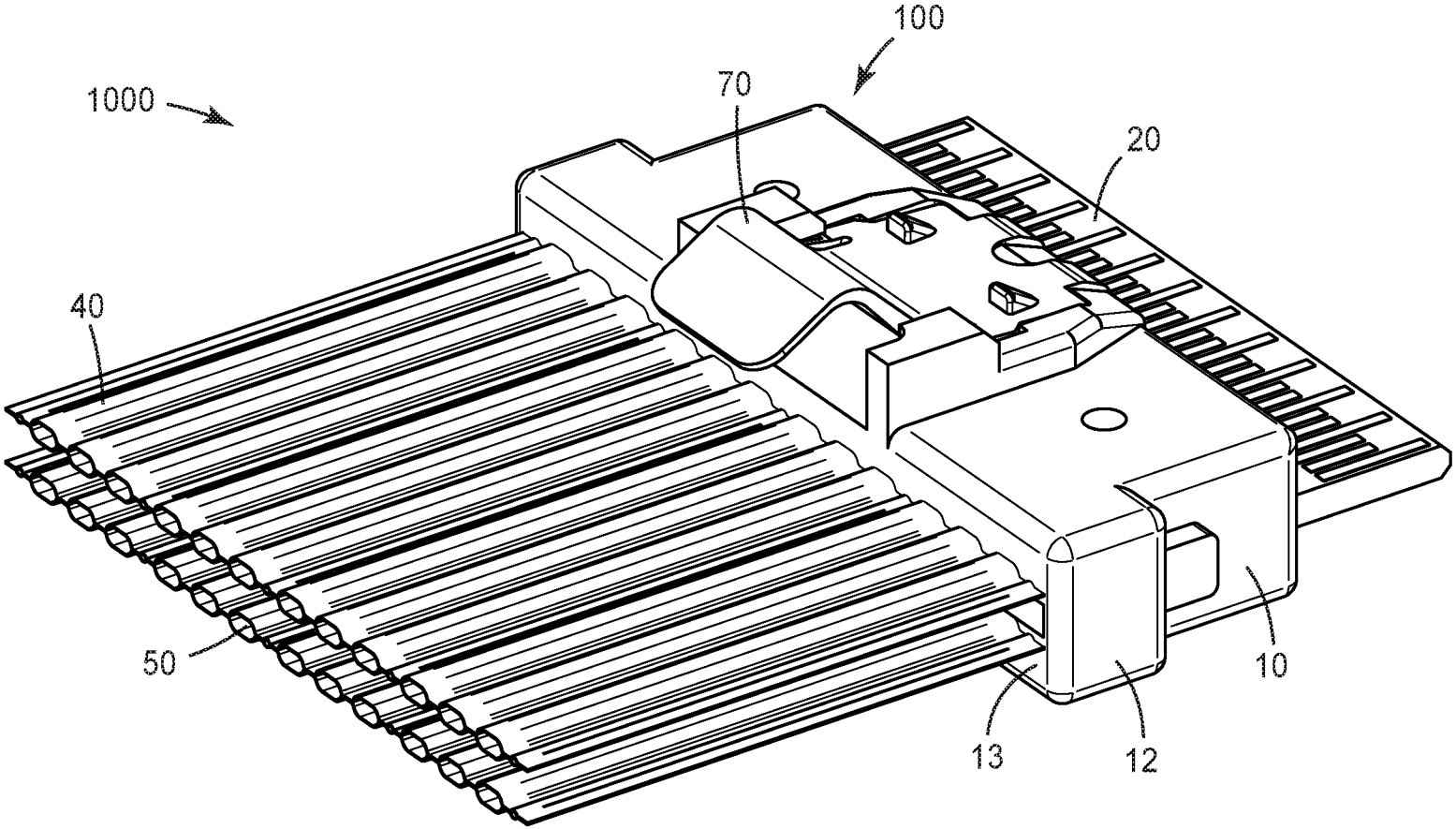
FIG. 1A is a schematic rear top perspective view of a connector assembly.
Figure 1B:
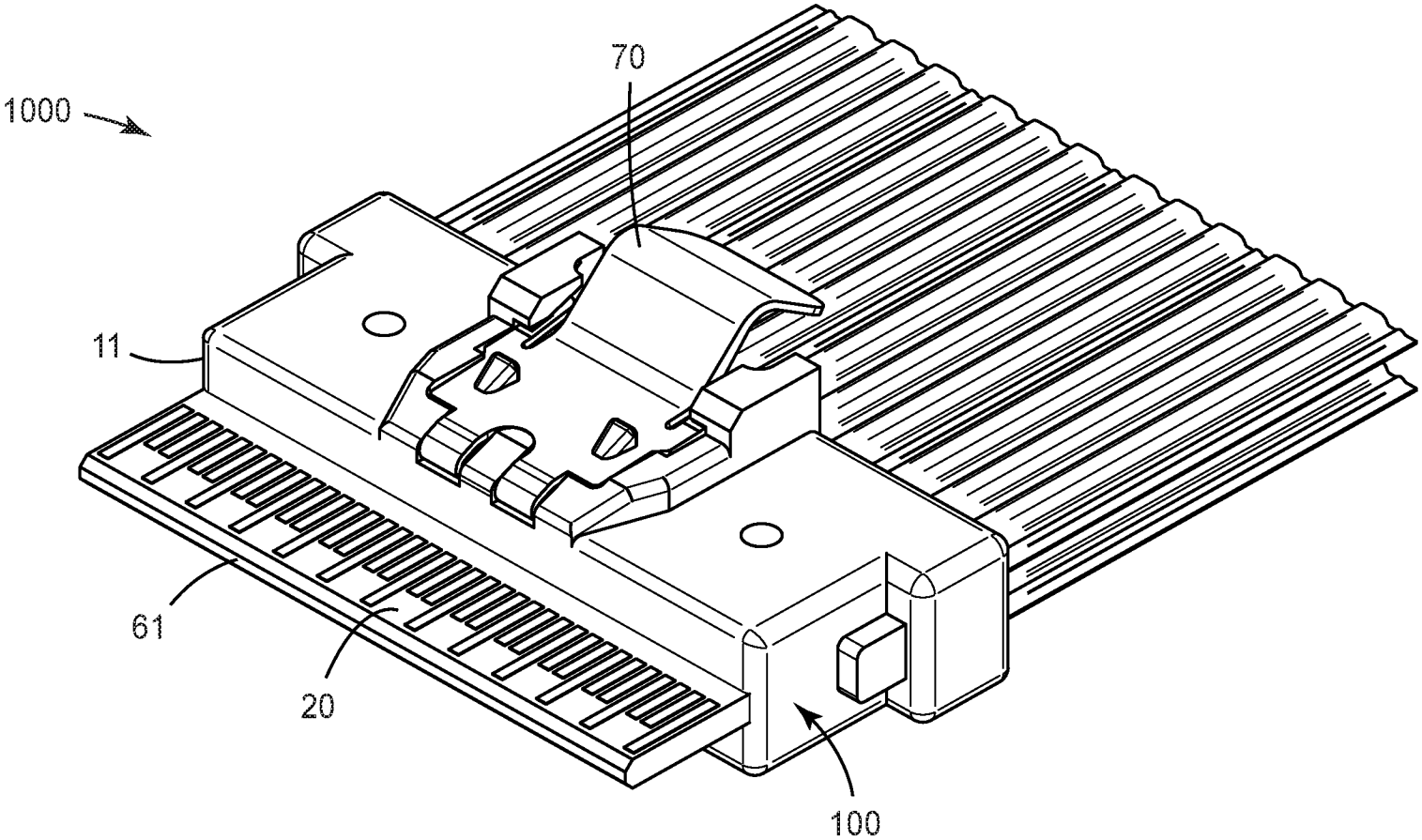
FIG. 1B is a schematic front top perspective view of the connector assembly of FIG. 1A.
Figure 1C:
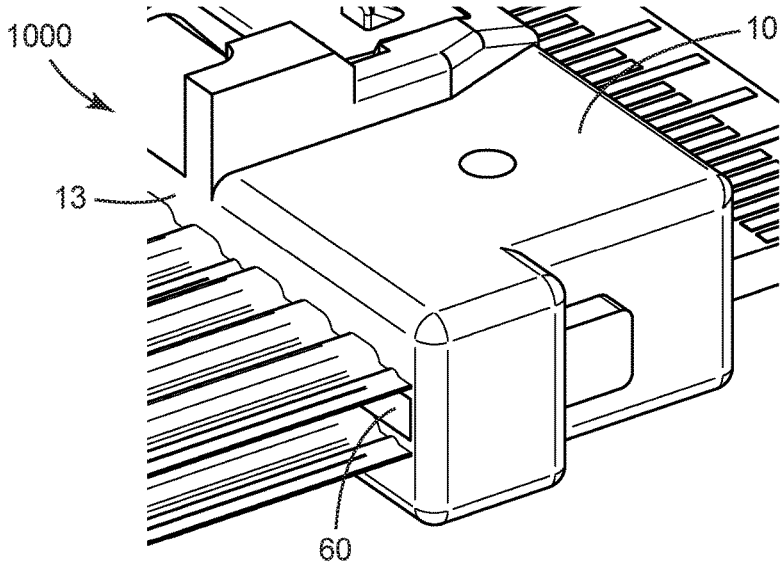
FIG. 1C is a schematic rear perspective view of a portion of the connector assembly of FIG. 1A.
Figure 1D:
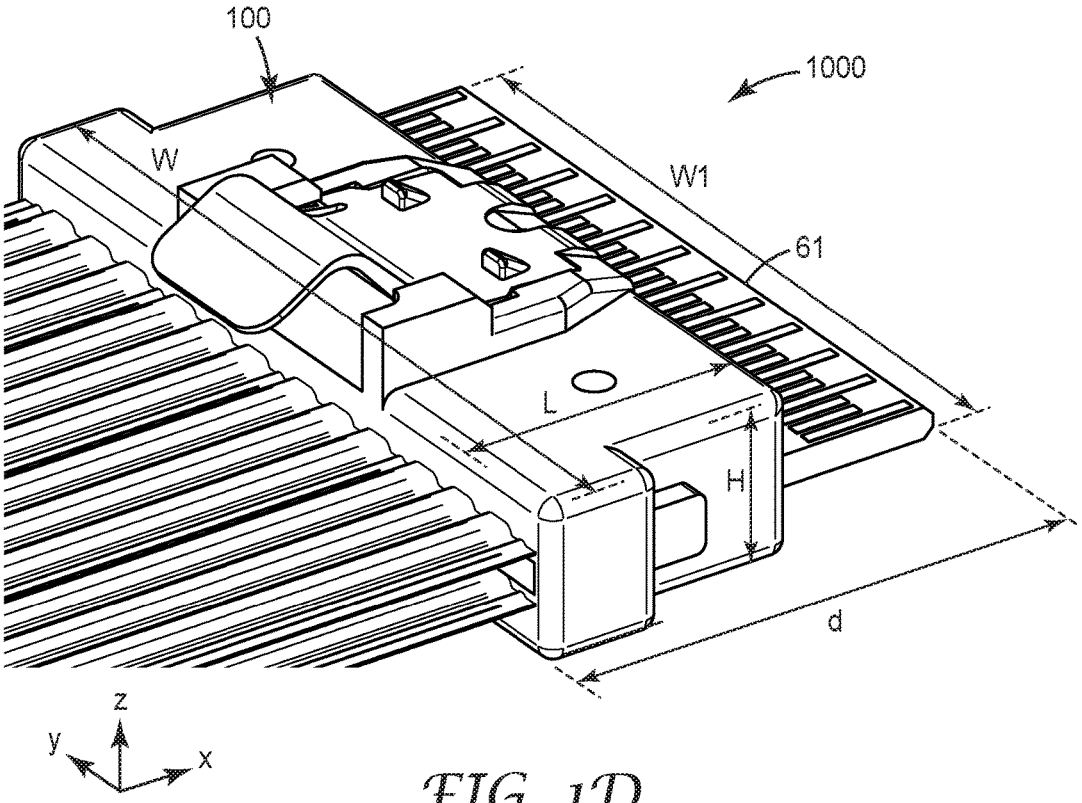
FIG. 1D is a schematic top perspective view of the connector assembly of FIG. 1A.
Figure 2A:
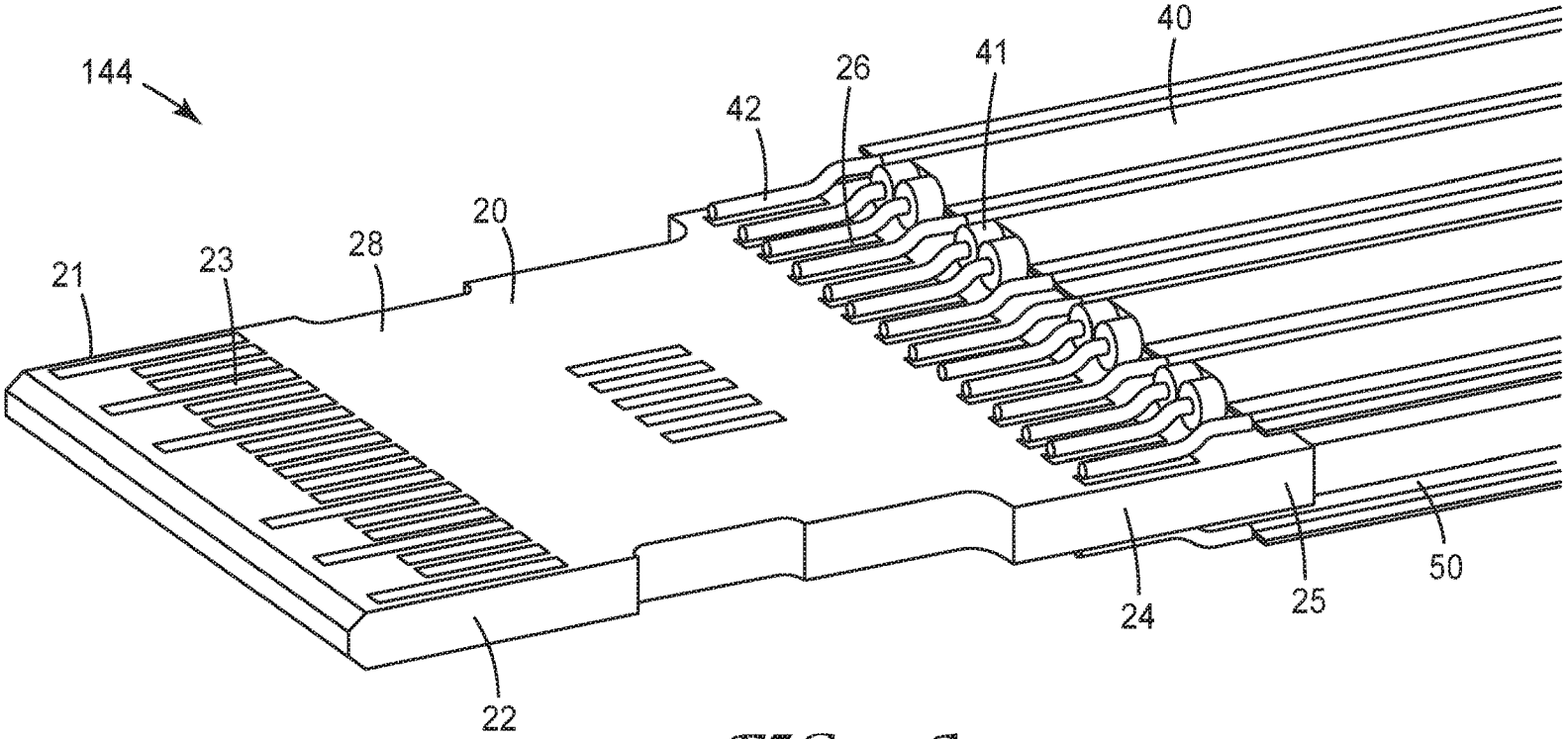
FIG. 2A is a schematic top perspective view of a cable assembly including a circuit board and first and second cables.
Figure 2B:
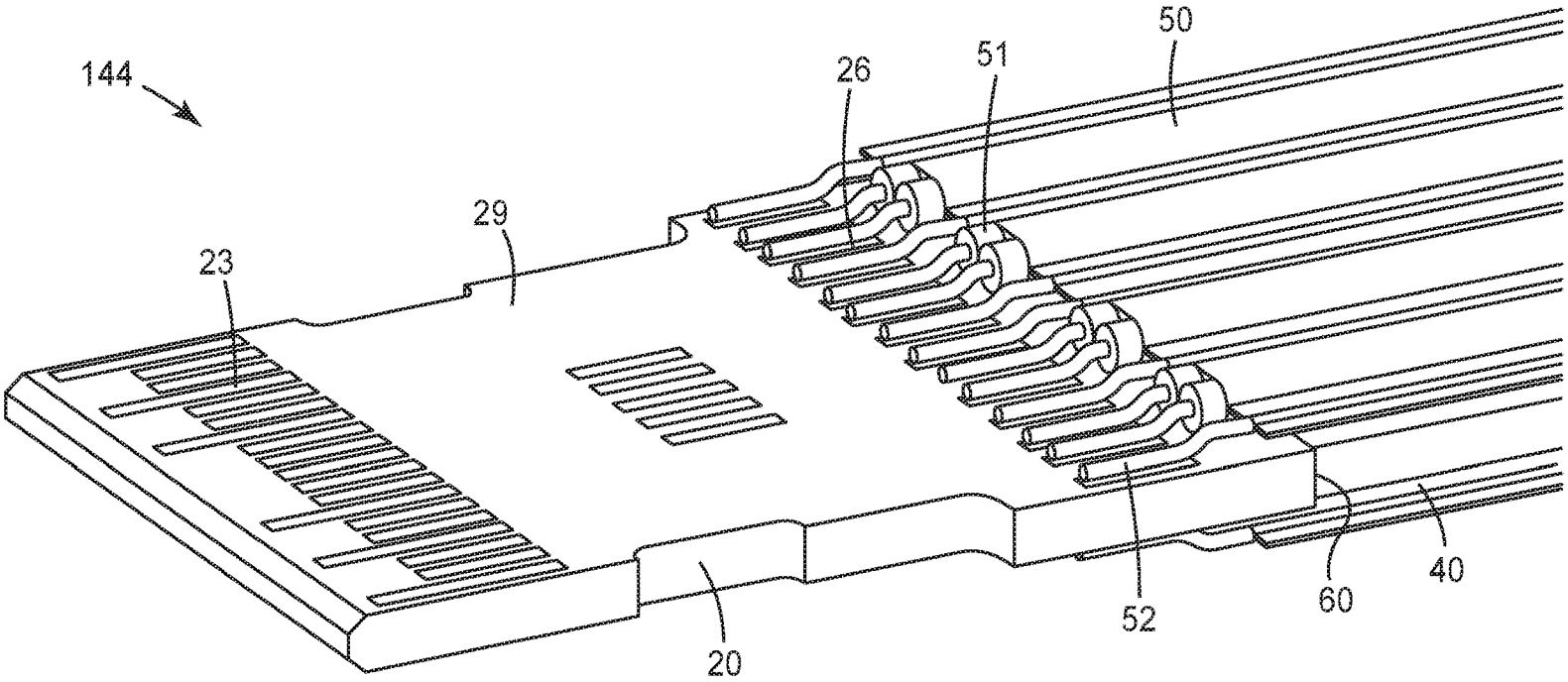
FIG. 2B is a schematic bottom perspective view of the cable assembly of FIG. 2A.
Figure 3A:
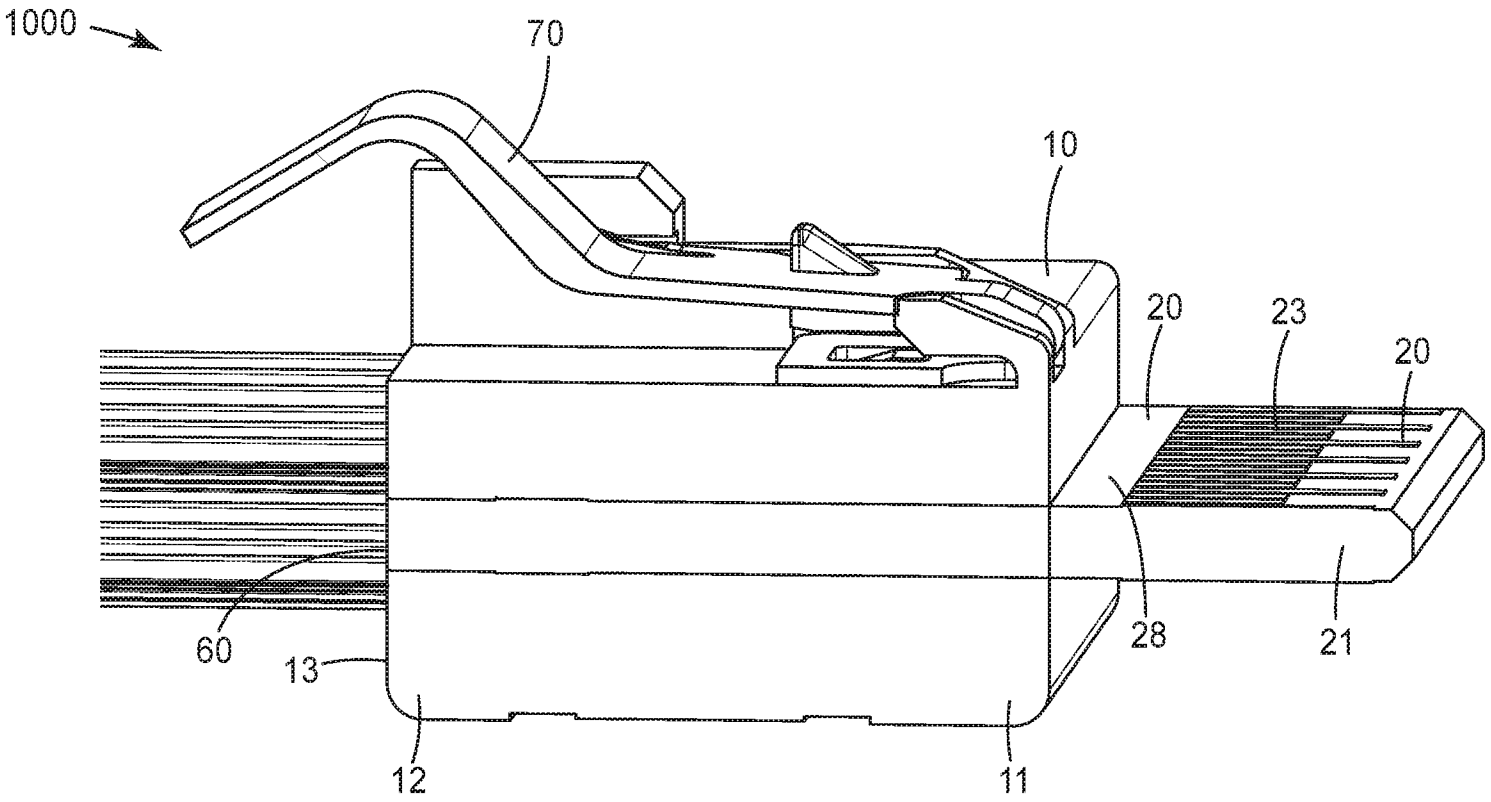
FIG. 3A is a schematic top side perspective cutaway view of a connector assembly.
Figure 3B:
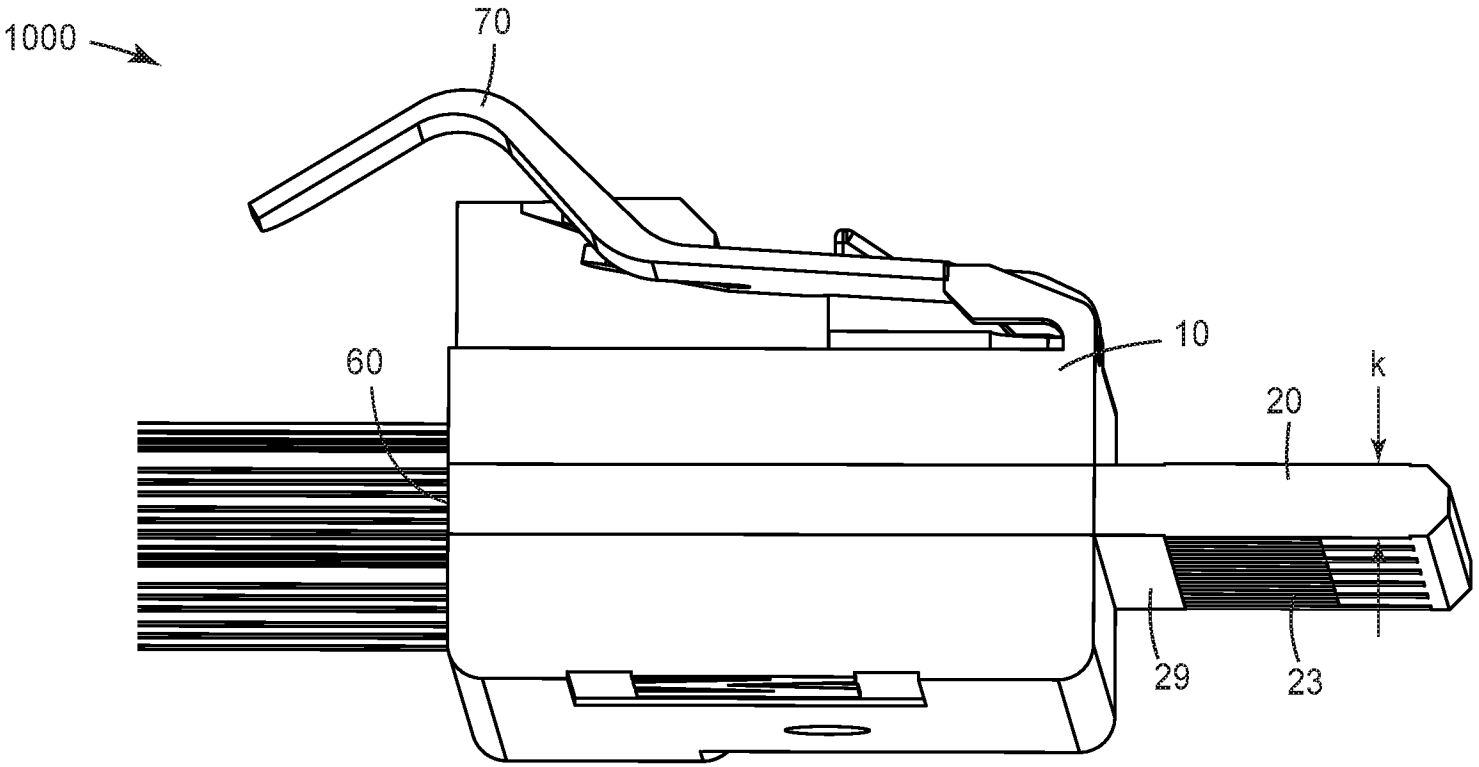
FIG. 3B is a schematic bottom side perspective cutaway view of the connector assembly of FIG. 3A.

FIG. 1A is a schematic rear top perspective view of a connector assembly 1000, FIG. 1B is a schematic front top perspective view of the connector assembly 1000, FIG. 1C is a schematic rear perspective view of a portion of the connector assembly 1000, and FIG. 1D is a schematic top perspective view of the connector assembly 1000. Connector assembly 1000 includes a connector 100 which includes an insulative housing 10 and a circuit board 20 partially disposed in the insulative housing 10. The insulative housing includes a mating end 11 and an opposing cable end 12. In some embodiments, the connector 100 includes a latching member 70 for latching the connector to a mating connector 200 as described further elsewhere herein. The connector assembly 1000 includes substantially flat first 40 and second 50 cables. A substantially flat cable may have a radius of curvature along the width of the cable that is substantially greater (e.g., at least 5 times, or at least 10 times, or at least 20 times) than the width of the cable, for example. FIG. 2A is a schematic top perspective view of a cable assembly 144 including the circuit board 20 and the first and second cables 40 and 50 and FIG. 2B is a schematic bottom perspective view of the cable assembly 144. The position of the circuit board 20 in the insulative housing 10 according to some embodiments is further illustrated in FIGS. 3A-3B. FIG. 3A is a schematic top side perspective cutaway view of the connector assembly 1000 and FIG. 3B is a schematic bottom side perspective cutaway view of the connector assembly 1000.

The circuit board 20 includes a mating section 21 at a front end 22 of the circuit board 20 and extending forwardly from the mating end 11 of the insulative housing (see, e.g., FIGS. 1B and 2A-2B). The mating section 21 includes a plurality of first contact pads 23 disposed on upper 28 and lower 29 sides of the circuit board 20 for making contact with corresponding contacts of a mating connector (see, e.g., corresponding contacts 210 of mating connector 200 depicted in FIG. 4). The circuit board 20 includes a termination section 24 at a rear end 25 of the circuit board 20 and disposed at the cable end 12 of the insulative housing 10. The termination section 24 includes a plurality of second contact pads 26 disposed on the upper and lower sides 28 and 29 of the circuit board 20 and electrically connected to the first contact pads 23. The circuit board has a thickness k (see, e.g., FIG. 3B).

As illustrated in FIGS. 2A-2B, for example, the first and second cables 40 and 50 include a plurality of substantially parallel electrical conductors 41 and 51, respectively. Substantially parallel electrical conductors may be parallel to within 20 degrees, or to within 10 degrees, or to within 5 degrees, or to within 3 degrees, for example. The front ends 42 and 52 of the conductors 41 and 51, respectively, are terminated at the corresponding second contact pads 26. In some embodiments, the insulative housing 10 is overmolded onto and encapsulates at least the front ends 42 and 52 of the conductors 41 and 51, respectively, and the termination section 24 of the circuit board 20.

The circuit board 20 includes a back surface 60 at the rear end 25 of the circuit board 20 that connects the upper and lower sides 28 and 29 of the circuit board 20. As illustrated in FIG. 1C, for example, the insulative housing 10 includes a back surface 13 at the cable end 12 of the insulative housing 10 that is, in some embodiments, substantially coplanar with the back surface 60 of the circuit board 20. In some embodiments, the first and second cables 40 and 50 are spaced apart from each other at the back surface 13 of the insulative housing 10 by at least the thickness k of the circuit board 20. The thickness k may be an average thickness of the circuit board 20 and/or may be the thickness of the circuit board 20 at the back surface 60.

The insulative housing 10 of the connector 100 has a length L along a mating direction (e.g., the x-direction depicted in FIG. 1D) of the connector, a width W along a lateral direction (e.g., the y-direction depicted in FIG. 1D) of the connector 100 orthogonal to the mating direction, and a thickness H along a thickness direction (e.g., the z-direction depicted in FIG. 1D) of the connector 100 orthogonal to the mating and lateral directions. In some embodiments, W>L>H. In some embodiments, W is greater than a width W1 of the circuit board 20. In some embodiments, a separation d between the front edge 61 of the circuit board 20 and the back surface 13 of the insulative housing 10 is less than 17 mm, or less than 16 mm. In some embodiments, the separation d is in a range of 13 mm to 17 mm or in a range of 14 mm to 16 mm. In some embodiments, the separation d between the front edge 61 of the circuit board 20 and the back surface 13 of the insulative housing 10 is about 15 mm (e.g., 15 mm±5%).

Figure 4:
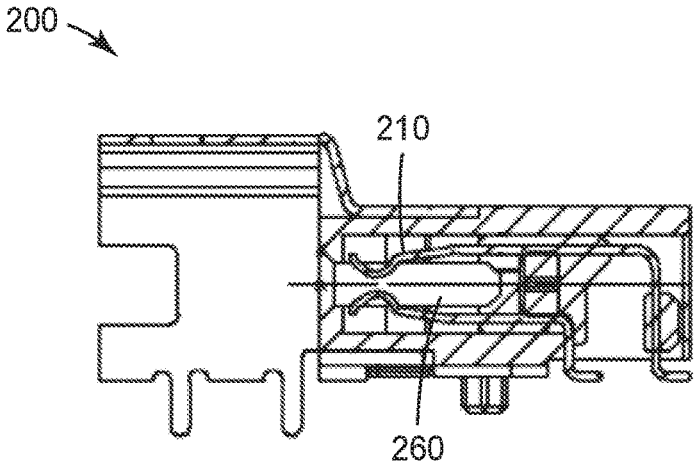
FIG. 4 is a schematic cross-sectional view of a mating connector.

FIG. 4 is a schematic cross-sectional view of an exemplary mating connector 200 which includes contacts 210. The mating connector 200 includes a cavity 260 for receiving a circuit board 20. When the connector assembly 1000 is mated with the mating connector 200, the plurality of first contact pads 23 make contact with corresponding contacts 210 of the mating connector 200.

Figure 5A:
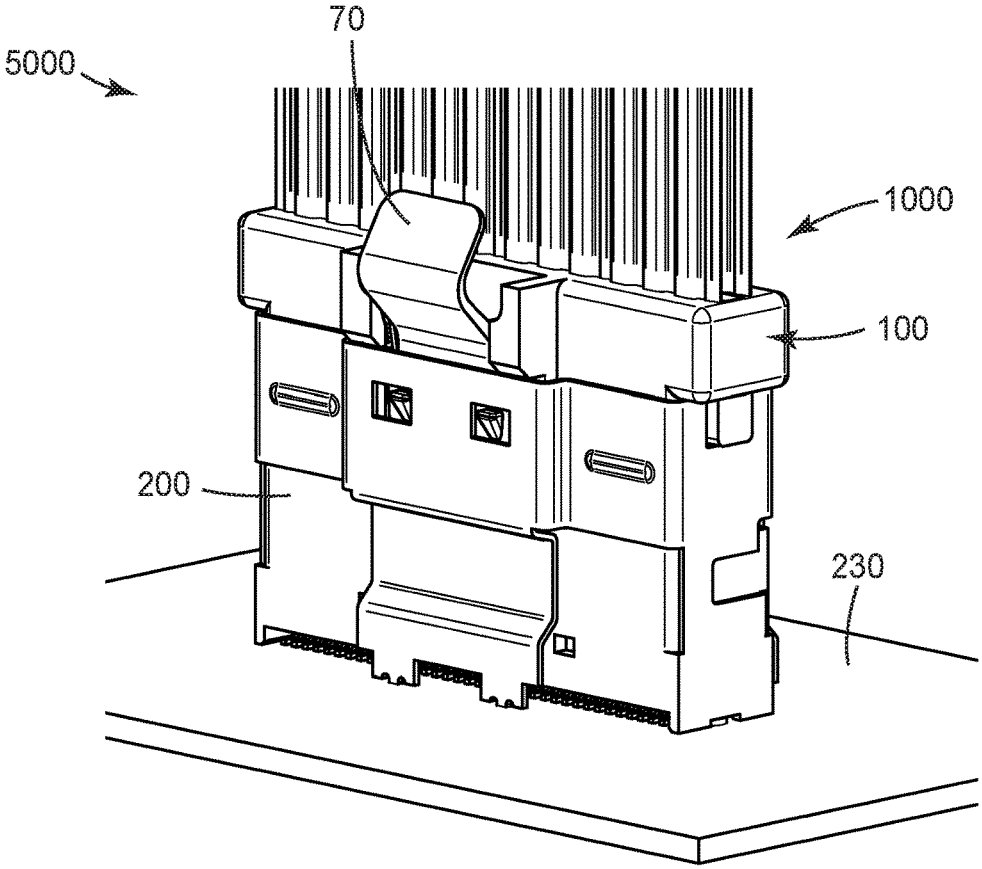
FIG. 5A is a schematic perspective view of an assembly including a connector mated with a mating connector mounted on a circuit board.
Figure 5B:
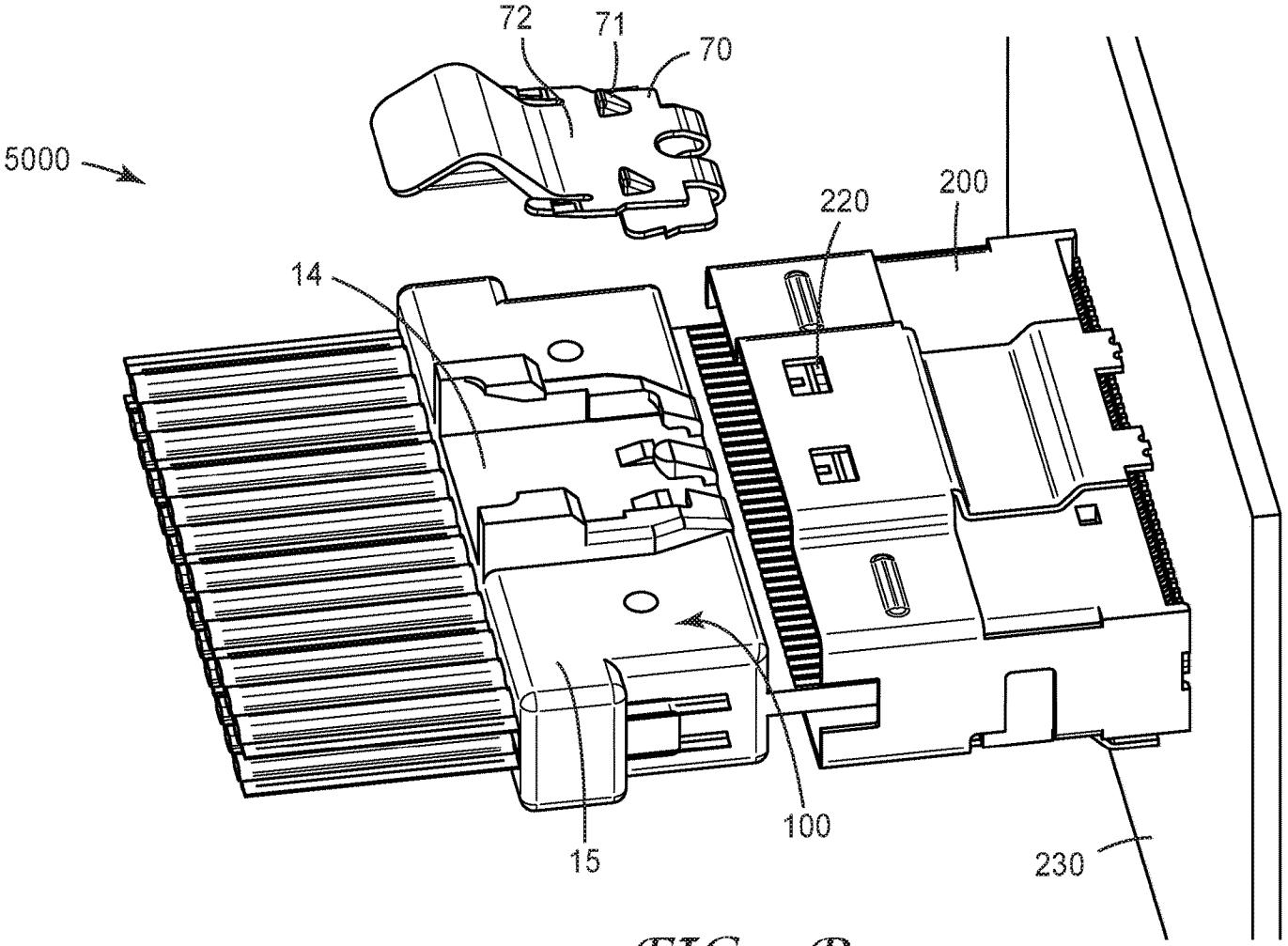
FIG. 5B is a schematic exploded view of the assembly of FIG. 5A.

FIG. 5A is a schematic perspective view of an assembly 5000 including the connector assembly 1000, where the connector 100 is mated with a mating connector 200 mounted on a circuit board 230. FIG. 5B is a schematic exploded view of the assembly 5000.

In some embodiments, the connector 100 includes a latching member 70 for latching the connector 100 to a mating connector 200. In some embodiments, the latching member 70 includes at least one latch 71 disposed on a resilient arm 72 of the latching member 70 and configured to engage an opening 220 defined by the mating connector 200. In some embodiments, the insulative housing 10 of the connector 100 includes a latch receiving area 14 disposed on a top major surface 15 of the insulative housing 10 for receiving and removably attaching to the latching member 70. In some embodiments, the latching member 70 is removably received in and attached to the latch receiving area 14 of insulative housing 10 for latching the connector assembly 1000 to the mating connector 200.

The substantially coplanar back surface 13 and the back surface 60 may be in a same plane or may deviate from being in a same plane by a distance substantially smaller (e.g., at least a factor of 2 smaller) than the thickness k of the circuit board 20, for example. For example, the substantially coplanar back surface 13 and the back surface 60 may nominally in a same plane but may deviate from being in a same plane due to normal manufacturing variations. In some embodiments, a plane of the back surface 13 of the insulative housing 10 and a plane of the back surface 60 of the circuit board 20 are displaced from one another by a distance less than 0.5 times, or less than 0.25 times, or less than 0.1 times the thickness k of the circuit board 20. In some embodiments, the insulative housing 10 includes a skin layer extending unitarily from the back surface 13 of the insulative housing 10 and at least partially covering the back surface 60 of the circuit board 20. The skin layer may have a thickness (e.g., a maximum thickness) of less than 0.5 times, or less than 0.25 times, or less than 0.1 times the thickness k of the circuit board 20. In some embodiments, the skin layer has a maximum thickness less than 0.5 mm, or less than 0.25 mm, or less than 0.1 mm. The skin layer may have a uniform thickness or a varying thickness. The skin layer may cover all or substantially all of the back surface 60 or may cover only a portion of the back surface 60. In some embodiments, the skin layer is not present.

Figure 6:
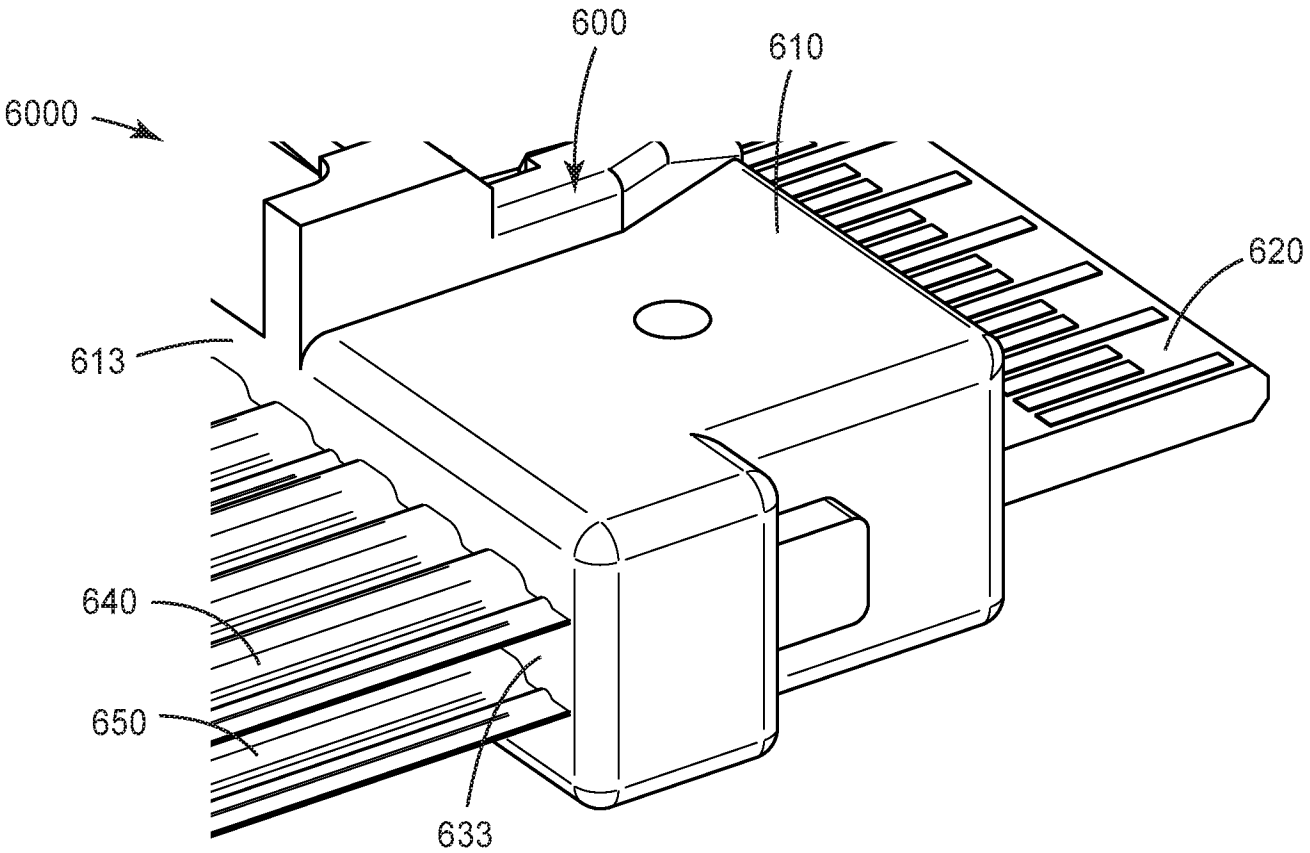
FIG. 6 is a schematic rear perspective view of a portion of a connector assembly.

FIG. 6 is a schematic illustration of a connector assembly 6000 including first and second cables 640 and 650 and including connector 600 including a circuit board 620 and an insulative housing 610 having a back surface 613 and including a skin layer 633 extending unitarily from the back surface 613 and at least partially covering the back surface of the circuit board 620. Connector assembly 6000 and connector 600 may correspond to connector assembly 6000 and connector 600, respectively, except for the skin layer 633.

Figure 7A:
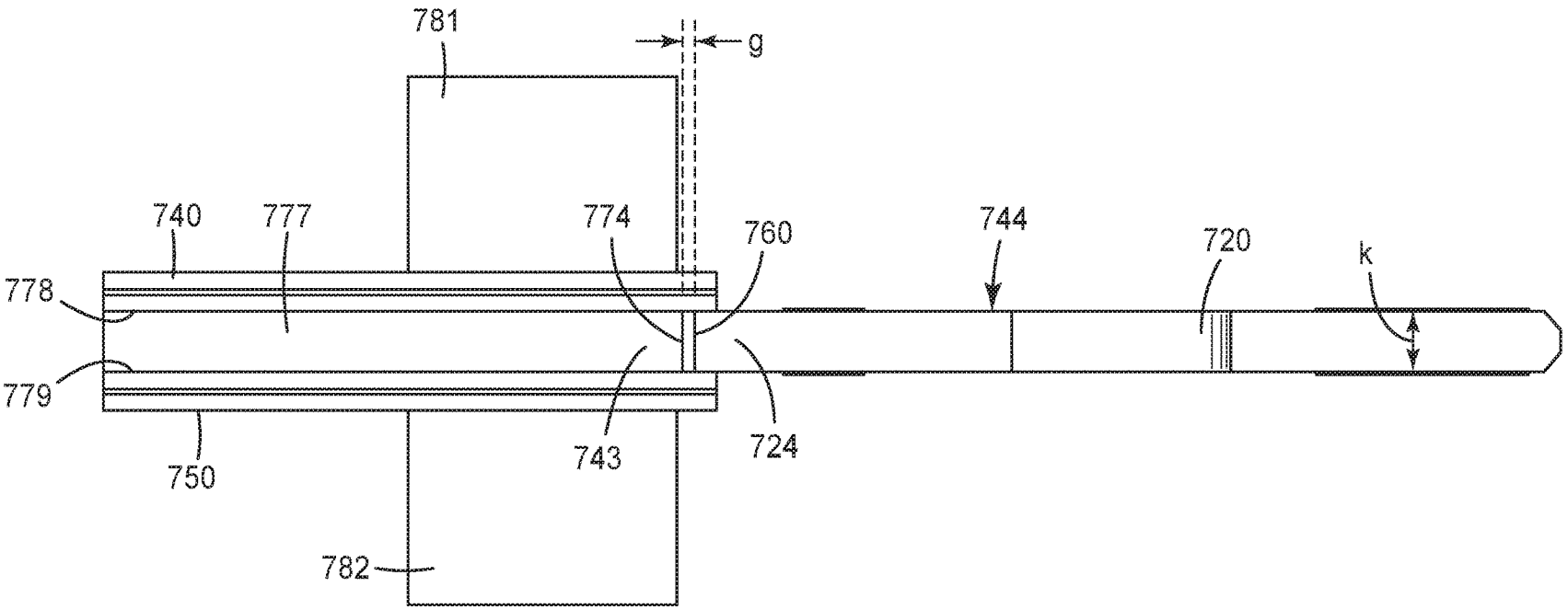
FIGS. 7A-7B are schematic illustrations of steps in a method of making a connector assembly.
Figure 7B:
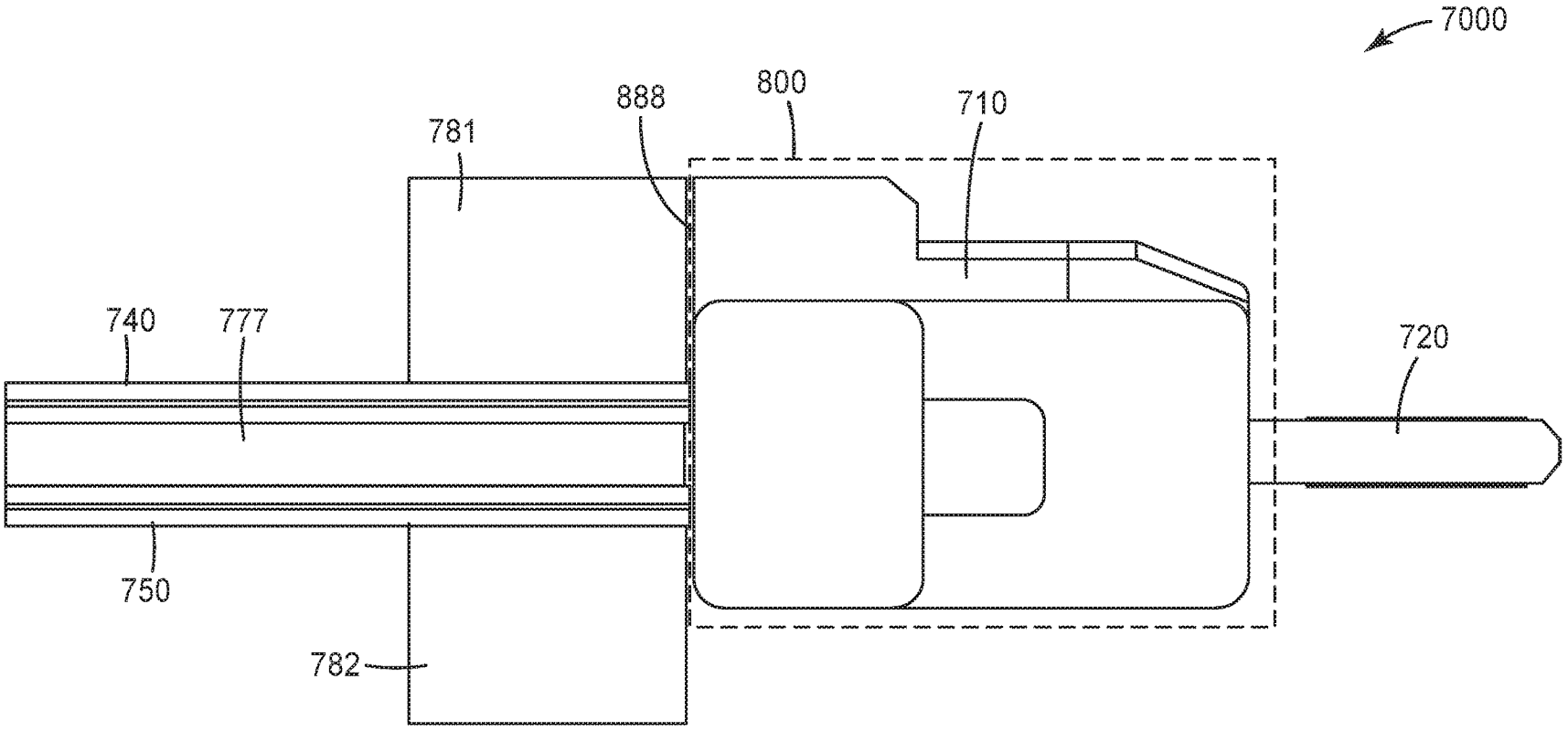

FIGS. 7A-7B are schematic illustrations of steps in a method of making a connector assembly 7000. A cable assembly 744 including a circuit board 720 having a thickness k and attached to first and second cables 740 and 750 is illustrated. Circuit board 720 may correspond to circuit board 20, for example, and connector assembly 7000 may correspond to connector assembly 1000, for example. In some embodiments, a process for making a connector assembly 7000 includes disposing a spacer fixture 777 between first and second cables 740 and 750 and adjacent a circuit board 720 such that the spacer fixture 777 has opposing first and second major surfaces 778 and 779 facing the respective first and second cables 740 and 750 and an edge surface 774 is adjacent to and substantially aligned with an edge surface or back surface 760 of the circuit board 720 at a rear end of the circuit board 720 with a maximum separation g of the edge surface 774 of the spacer fixture 777 and the back surface 760 of the circuit board 720 being less than half a thickness k of the circuit board 720. The edge surface 774 is at an end 743 of the spacer fixture 777 and connects the first and second major surfaces 778 and 779. The process further includes molding an insulative housing 710 onto at least a termination section 724 of the circuit board 720 and front ends of conductors of the first and second cables 740 and 750 terminated at contact pads in the termination section 724 while the spacer fixture 777 maintains a spacing between the first and second cables 740 and 750 to provide the connector assembly 7000. In some embodiments, the molded insulative housing 710 encapsulates at least the termination section 724 and the front ends of the conductors. The process further includes separating the connector assembly 7000 and the spacer fixture 777 from one another. The molding process may include disposing upper and lower mold portions 781 and 782 on opposite sides of the first and second cables 740 and 750. The upper and lower mold portions 781 and 782 may be disposed to provide resin to a mold 800 having an open port 888 and having a cavity defining the shape of the insulative housing 710. In FIG. 7B, an outline of the mold 800 is schematically illustrated and the injection molded housing 710 is shown. The mold 800, the upper and lower mold portions 781 and 782, and the spacer fixture 777 may be removed from the connector assembly 7000.

In some embodiments, a method of making a connector assembly 7000 includes providing a mold 800 having an open port 888 and providing a cable assembly 744. The cable assembly 744 includes a circuit board 720 having upper and lower sides, an edge surface 760 connecting the upper and lower sides, and a plurality of contact pads disposed on the upper and lower sides of the circuit board proximate the edge surface 760; and substantially flat first and second cables 740 and 750 terminated at the contact pads. The method further includes placing the cable assembly 744 at least partially within the mold 800 so that the edge surface 760 of the circuit board 720 is placed substantially at the open port 888 of the mold 800, disposing a spacer fixture 777 between the first and second cables 740 and 750 so that an edge surface 774 of the spacer fixture 777 is substantially aligned, and makes contact or near contact, with the edge surface 760 of the circuit board 720 so that the spacer fixture 777 substantially seals the open port 888 of the mold 800 and maintains a spacing between the first and second cables 740 and 750 at the edge surface 760 of the circuit board 720, molding an insulative housing 710 within the mold 800 over at least the plurality of contact pads; and removing the spacer fixture 777 to provide the connector assembly 7000. The removing step is carried out after the molding step, and the molding step is carried out after each of the placing and disposing steps.

The edge surface 774 may be substantially aligned with the back surface 760 such that there is a substantially constant (e.g., varying by less than 20% or less than 10% of the thickness k of the circuit board 720) separation (which may be zero corresponding to direct contact) between the edge surface 774 and the back surface 760. The edge surface 774 may be substantially aligned with the back surface 760 such that the edge surface 774 and the back surface 760 are substantially parallel (e.g., within 20 degrees, or with 10 degrees, or within 5 degrees of parallel). During the molding step, the edge surface 774 and the edge surface 760 may contact one another or nearly contact one another so that a maximum separation g of the edge surface 774 of the spacer fixture 777 from the edge surface 760 of the circuit board 720 is less than a half or less than a fourth of the thickness of the circuit board 720. In some embodiments, the maximum separation g of the edge surface 774 and the back surface 760 is substantially zero (e.g., less than 0.1 times the thickness k).

In some embodiments, the insulative housing 710 includes a back surface at an end of the insulative housing 710 substantially coplanar with back surface 760 of the circuit board 720. In some embodiments, the first and second cables 740 and 750 of the connector assembly 7000 are spaced apart from each other at the back surface of the insulative housing 710 by at least the thickness k of the circuit board 720.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A connector assembly comprising:

a connector comprising:

an insulative housing comprising a mating end and an opposing cable end; and a circuit board partially disposed in the insulative housing and comprising:

a mating section at a front end of the circuit board and extending forwardly from the mating end of the insulative housing, the mating section comprising a plurality of first contact pads disposed on upper and lower sides of the circuit board for making contact with corresponding contacts of a mating connector; and a termination section at a rear end of the circuit board and disposed at the cable end of the insulative housing, the termination section comprising a plurality of second contact pads disposed on the upper and lower sides of the circuit board and electrically connected to the first contact pads; and substantially flat first and second cables comprising a plurality of substantially parallel electrical conductors, front ends of the conductors terminated at the corresponding second contact pads; wherein the insulative housing is overmolded onto and encapsulates at least the front ends of the conductors and the termination section of the circuit board, wherein the circuit board comprises a back surface at the rear end of the circuit board and connecting the upper and lower sides of the circuit board, wherein the insulative housing comprises a back surface at the cable end of the insulative housing substantially coplanar with the back surface of the circuit board, and wherein the first and second cables are spaced apart from each other at the back surface of the insulative housing by at least a thickness of the circuit board.

2. The connector assembly of claim 1, wherein the connector further comprises a latching member for latching the connector to a mating connector.

3. The connector assembly of claim 2, wherein the latching member comprises at least one latch disposed on a resilient arm of the latching member and configured to engage an opening defined by a mating connector.

4. The connector assembly of claim 1, wherein the insulative housing of the connector comprises a latch receiving area disposed on a top major surface of the insulative housing for receiving and removably attaching to a latching member; and a latching member removably received in and attached to the latch receiving area of the insulative housing for latching the connector assembly to a mating connector.

5. The connector assembly of claim 1, wherein the insulative housing of the connector comprises a length L along a mating direction of the connector, a width W along a lateral direction of the connector orthogonal to the mating direction, and a thickness H along a thickness direction of the connector orthogonal to the mating and lateral directions, W>L>H.

6. The connector assembly of claim 1, wherein W is greater than a width of the circuit board.

7. The connector assembly of claim 1, wherein a separation between a front edge of the circuit board and the back surface of the insulative housing is less than 17 mm.

8. The connector assembly of claim 1, wherein a separation between a front edge of the circuit board and the back surface of the insulative housing is less than 16 mm.

9. The connector assembly of claim 1, wherein a separation between a front edge of the circuit board and the back surface of the insulative housing is about 15 mm.

10. An assembly comprising the connector assembly of claim 1, wherein the connector is mated with a mating connector mounted on a circuit board.

11. The connector assembly of claim 1, wherein the insulative housing comprises a skin layer extending unitarily from the back surface of the insulative housing and at least partially covering the back surface of the circuit board.

12. The connector assembly of claim 11, wherein the skin layer has a thickness less than half the thickness of the circuit board.

13. The connector assembly of claim 11, wherein the skin layer has a thickness less than a fourth of the thickness of the circuit board.

14. A method of making a connector assembly, the method comprising:

providing a mold comprising an open port;

providing a cable assembly comprising:

a circuit board comprising upper and lower sides, an edge surface connecting the upper and lower sides, and a plurality of contact pads disposed on the upper and lower sides of the circuit board proximate the edge surface; and substantially flat first and second cables terminated at the contact pads;

placing the cable assembly at least partially within the mold so that the edge surface of the circuit board is placed substantially at the open port of the mold;

disposing a spacer fixture between the first and second cables so that an edge surface of the spacer fixture is substantially aligned, and makes contact or near contact, with the edge surface of the circuit board so that the spacer fixture substantially seals the open port of the mold and maintains a spacing between the first and second cables at the edge surface of the circuit board;

molding an insulative housing within the mold over at least the plurality of contact pads; and removing the spacer fixture to provide the connector assembly.

15. The method of claim 14, wherein during the molding step, a maximum separation of the edge surface of the spacer fixture from the edge surface of the circuit board is less than a fourth of the thickness of the circuit board.

16. The method of claim 15, wherein the maximum separation is substantially zero.

17. The method of claim 14, wherein the insulative housing comprises a back surface at an end of the insulative housing substantially coplanar with the edge surface of the circuit board.

18. The method of claim 14, wherein the insulative housing comprises a back surface at an end of the insulative housing adjacent the edge surface of the circuit board, the first and second cables of the connector assembly being spaced apart from each other at the back surface of the insulative housing by at least the thickness of the circuit board.

* * * * *